US006824112B2

(12) United States Patent
Lange

(10) Patent No.: US 6,824,112 B2
(45) Date of Patent: Nov. 30, 2004

(54) BABY BOTTLE HOLDER

(75) Inventor: Helmut Lange, Minnetonka, MN (US)

(73) Assignee: HLLB, LLC, Minnetonka, MN (US)

( * ) Notice: Subject to any disclaimer, the term of this patent is extended or adjusted under 35 U.S.C. 154(b) by 0 days.

(21) Appl. No.: 10/262,029

(22) Filed: Oct. 1, 2002

(65) Prior Publication Data

US 2004/0061031 A1 Apr. 1, 2004

(51) Int. Cl.[7] ..... A47D 15/00

(52) U.S. Cl. ..... 248/102; 248/103; 248/105; 446/73

(58) Field of Search ..... 220/737, 739, 220/903; 446/73, 74, 77, 71, 76, 72; 248/102, 103, 104, 105, 915; 215/11.6, 395; 224/148.6, 148.7; D24/199, 45

(56) References Cited

U.S. PATENT DOCUMENTS

| | | | | | |
|---|---|---|---|---|---|
| 747,025 | A | * | 12/1903 | White | 215/12.1 |
| 922,413 | A | * | 5/1909 | Friedrich | 215/12.1 |
| 1,188,904 | A | * | 6/1916 | Cosgriff | 215/12.1 |
| 1,438,272 | A | * | 12/1922 | Snyder et al. | 215/11.6 |
| D67,140 | S | * | 4/1925 | Dupont | D24/199 |
| 1,589,138 | A | * | 6/1926 | Fisk | 215/11.6 |
| 1,669,061 | A | * | 5/1928 | Meltzer | 215/11.6 |
| 2,024,553 | A | * | 12/1935 | Tisdall | 215/12.1 |
| 2,399,647 | A | * | 5/1946 | Lockwood | 248/105 |
| D145,611 | S | * | 9/1946 | Butterfield | D24/199 |
| 2,409,820 | A | | 10/1946 | Zimmern | 215/12 |
| 2,522,381 | A | * | 9/1950 | Kramer | 215/12.1 |
| 2,706,571 | A | * | 4/1955 | Ryan | 215/12.1 |
| 2,729,259 | A | * | 1/1956 | Abrams | 215/12.1 |
| 3,613,761 | A | * | 10/1971 | Moody | 215/11.6 |
| 4,320,883 | A | * | 3/1982 | Bass | 248/104 |
| 4,776,546 | A | * | 10/1988 | Goldson et al. | 248/102 |
| 4,809,938 | A | | 3/1989 | Skinner et al. | 248/102 |
| 4,816,000 | A | * | 3/1989 | Hsu | 446/74 |
| D305,346 | S | | 1/1990 | Roberts | D21/162 |
| 4,946,119 | A | * | 8/1990 | Hellhake | 248/102 |
| 4,976,646 | A | * | 12/1990 | Hull | 446/74 |
| 4,989,811 | A | * | 2/1991 | Millis et al. | 248/104 |
| 5,072,843 | A | | 12/1991 | James | 215/100 R |
| 5,217,192 | A | | 6/1993 | Oktayuren | 240/102 |
| D356,379 | S | * | 3/1995 | Ibinger | D24/199 |
| 5,397,039 | A | * | 3/1995 | Parcelles | 224/148.5 |
| 5,582,335 | A | * | 12/1996 | Beard et al. | 224/148.5 |
| 5,667,419 | A | * | 9/1997 | Spector | 446/72 |
| D402,761 | S | | 12/1998 | Jones | D24/199 |
| 5,871,184 | A | | 2/1999 | Kaopio | 248/102 |
| 5,979,843 | A | | 11/1999 | Beck | 248/102 |
| 6,000,565 | A | * | 12/1999 | Ibeagwa | 215/11.6 |
| 6,082,681 | A | | 7/2000 | Rand | 248/102 |
| D443,933 | S | * | 6/2001 | Schindler | D24/199 |
| 6,523,792 | B2 | * | 2/2003 | Fishler | 248/102 |
| 6,641,094 | B2 | * | 11/2003 | Fishler | 248/102 |
| 6,739,933 | B2 | * | 5/2004 | Taylor | 446/28 |
| 2002/0104933 | A1 | | 8/2002 | Fishler | 248/102 |
| 2003/0121944 | A1 | * | 7/2003 | Scanlan et al. | 224/409 |

FOREIGN PATENT DOCUMENTS

| | | | |
|---|---|---|---|
| JP | 05042197 A | * | 2/1993 |

* cited by examiner

*Primary Examiner*—Ramon O. Ramirez
*Assistant Examiner*—Naschica S. Morrison
(74) *Attorney, Agent, or Firm*—Schwegman, Lundberg, Woessner & Kluth, P.A.

(57) ABSTRACT

A baby bottle holder that includes a stuffed toy body and a sleeve extending through the stuffed toy body to form at least one opening in the stuffed toy body. The baby bottle holder further includes a bottle retainer that is positioned within the sleeve and spaced from a first end and a second end of the sleeve. The bottle retainer may be positioned such that only a nipple of a baby bottle is exposed outside a mouth of the stuffed toy body when the baby bottle is secured within the bottle holder. Another aspect relates to a baby bottle holder that includes a tether attached to the stuffed toy body to secure the baby bottle holder to an object.

14 Claims, 4 Drawing Sheets

BABY BOTTLE HOLDER

TECHNICAL FIELD

This application relates generally to baby bottle holders and, more particularly, to stuffed toys that serve as baby bottle holders.

BACKGROUND

FIG. 1 illustrates a conventional baby bottle 10. The bottle 10 includes a container 11 and a cap 12. Cap 12 typically includes interior threads that are screwed onto exterior threads on container 11 to secure cap 12 to container 11. Container 11 includes a closed end 13 and an open end (not visible in FIG. 1 due to cap 12). A side wall 14 extends from closed end 13 toward the open end. As side wall 14 nears the open end of container 11, side wall 14 narrows to form a neck 15. The exterior threads on container 11 are usually on neck 15.

Cap 12 typically includes a nipple 16 that is secured within a base 17. The interior threads on cap 12 are usually on base 17. A recess 18 is typically formed on the outside of bottle 10 by a lower edge 19 of base 17 and the slope of neck 15.

The shape of conventional baby bottles, such as bottle 10, often makes it difficult for a baby to manipulate their own feeding bottle. A baby will frequently drop their bottle and have problems retrieving the bottle.

One solution to the problem is to have an adult in constant attendance while the baby is feeding. This solution may not be acceptable if the adult is supervising other children.

Another solution is to utilize a baby bottle holder that holds the baby bottle. Baby bottle holders are typically easier for a child to grasp and hold.

FIG. 2 illustrates one type of prior art baby bottle holder 20. Holder 20 includes a stuffed toy (e.g., animal) body 21 that has an opening 22 defined by a sleeve 23 extending through stuffed body 21. Sleeve 23 extends from a bottom end 24 to a head end 25 of stuffed body 21.

Opening 22 formed by sleeve 23 is typically smaller than bottle 10 such that sleeve 23 is compressed outward as bottle 10 is forced into opening 22. The force generated by stuffed body 21 on bottle 10 is often unsuitable to hold bottle 10 when opening 22 is vertically oriented, especially when holder 20 is subjected to movements caused by a baby.

A retainer, such as elastic retainer 26, is positioned at the head end 25 of sleeve 23 to secure a portion of bottle 10 inside stuffed body 21. Retainer 26 includes an opening that is smaller than the diameter of bottle 10 at recess 18. Retainer 26 expands as bottle 10 is inserted through retainer 26 and moves partially back toward its original size when retainer 26 engages recess 18. Once retainer 26 is positioned within recess 18 of bottle 10, the compressive force generated by retainer 26 on bottle 10 as well as the lateral constraint provided by lower edge 19 of base 17 and neck 15 secure bottle 10 inside stuffed body 21.

One drawback with bottle holder 20 is that it does not present enough of a pleasing appearance. Base 17 of cap 12 is exposed entirely outside of stuffed body 21 thereby detracting from the appearance of bottle holder 20. In addition, base 17 of cap 12 is typically made from hard plastic that could harm the baby, another child, or property if cap 12 were to strike any such objects, such as when a baby throws bottle holder 20.

Another drawback with bottle holder 20 is that there is no convenient way to secure bottle holder 20 to another object, such as a baby stroller. When the baby and bottle holder 20 are being transported somewhere, holder 20 needs to be held by the baby or parent, or packed away. Bottle holder 20 may be easily lost when it is held during transportation, especially if bottle holder 20 is held by the baby. Packing the holder away for transportation may be impossible, or at least undesirable because the baby would have limited access to bottle holder 20 during transportation.

Therefore, a baby bottle holder is needed which provides an improved appearance. It would also be desirable if the baby bottle holder concealed any hard plastic parts on a conventional baby bottle within the holder. In addition, the baby bottle holder should be able to be secured to an object that is close to the baby.

SUMMARY

A baby bottle holder that includes a stuffed toy body and a sleeve extending through the stuffed toy body to form at least one opening in the stuffed toy body. The baby bottle holder further includes a bottle retainer that is positioned within the sleeve and spaced from a first end and a second end of the sleeve.

The need to conceal the hard plastic parts on the bottle, especially the cap, is addressed by spacing the bottle retainer away from the ends of the sleeve to position all of the hard plastic parts on a bottle held by the bottle holder within the stuffed toy body. In some example embodiments, the bottle retainer can be positioned with the sleeve such that only the nipple of the baby bottle is exposed outside a mouth of the stuffed toy body when the baby bottle is secured within the bottle holder.

Another aspect relates to a baby bottle holder that includes a stuffed toy body and a sleeve extending through the stuffed toy body to form at least one opening in the stuffed toy body that receives a baby bottle. The baby bottle holder further includes a tether attached to the stuffed toy body to secure the baby bottle holder to an object.

The tether allows the baby bottle holder to be secured to a stroller or the like. Depending on the location of the tether and baby, the tether may provide continuous access to the baby bottle holder by the baby, especially when the baby and bottle holder are being transported from one location to another.

These and other aspects, embodiments and features will become apparent from the following description and referenced drawings.

DETAILED DESCRIPTION

Figure 1:
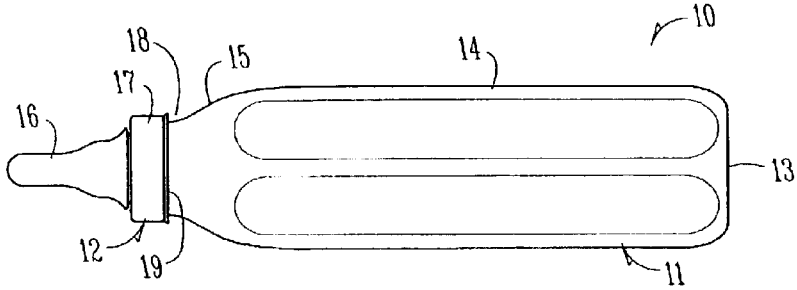
FIG. 1 is a side elevation view of a conventional baby bottle.
Figure 2:
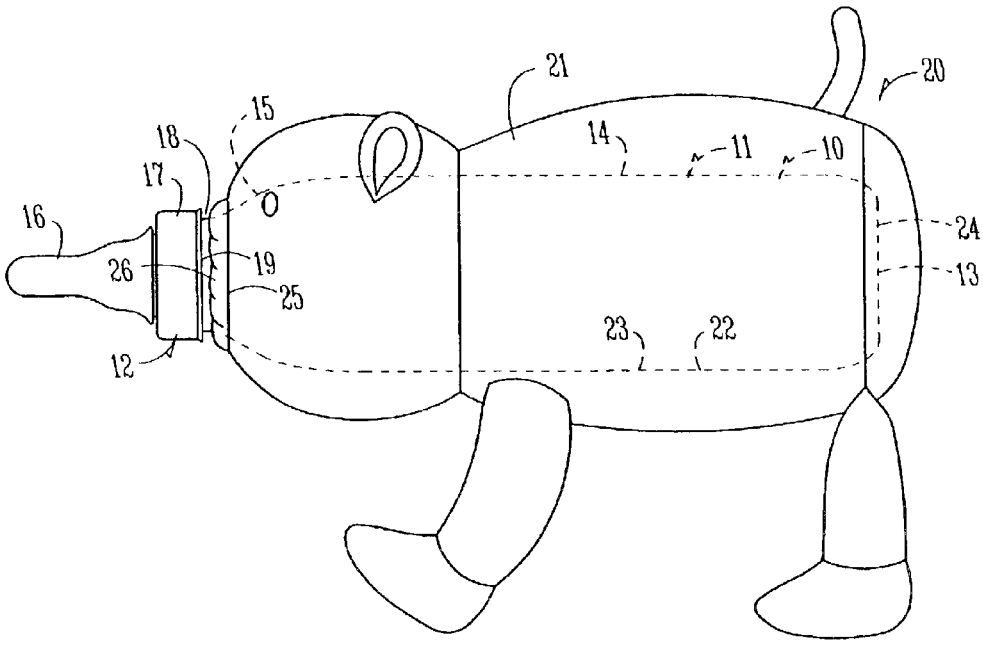
Fig. 2 (Prior Art)
FIG. 2 is a side elevation view of a prior art baby bottle holder.
Figure 3:
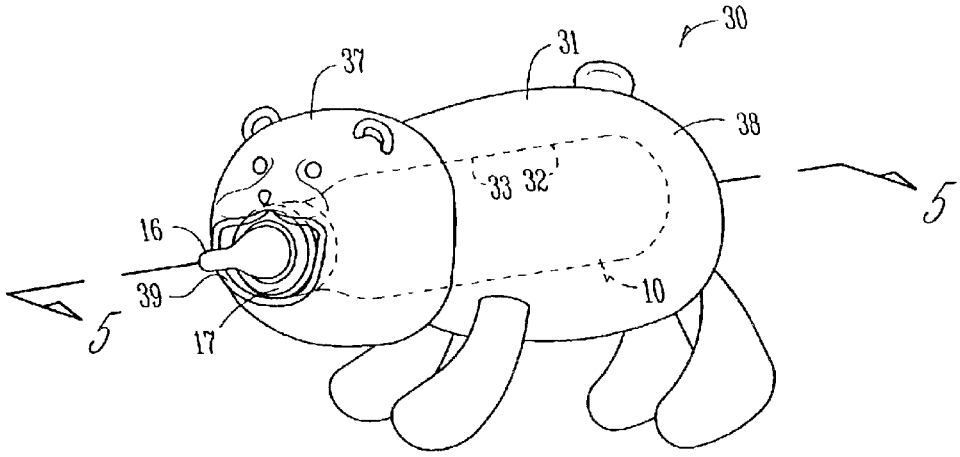
FIG. 3 is a perspective view of an example baby bottle holder.
Figure 4:
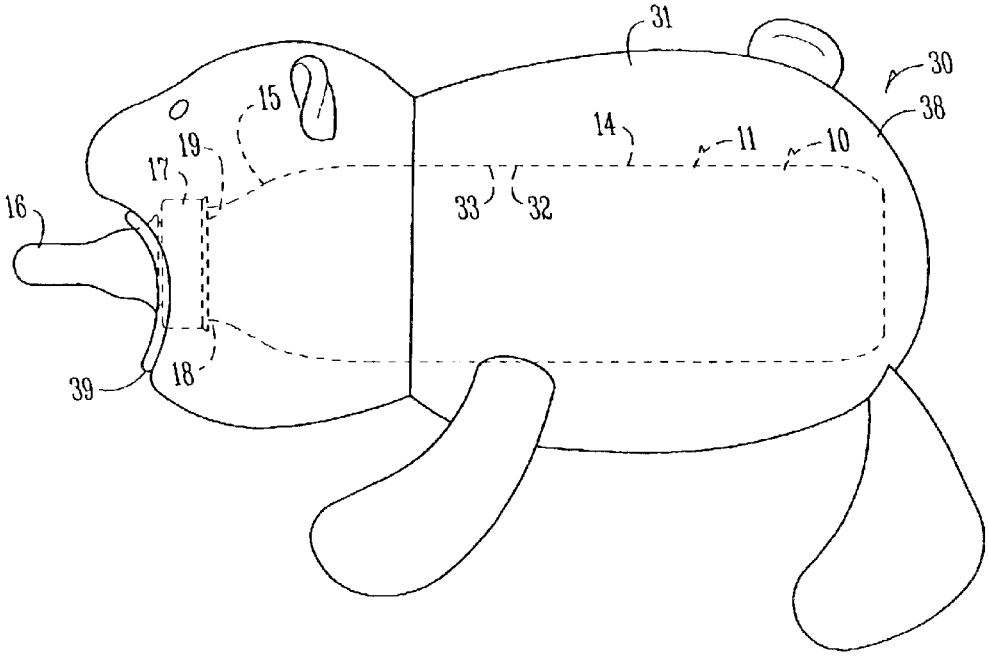
FIG. 4 is a side elevation view of the baby bottle holder of FIG. 3.

The following detailed description refers to the accompanying drawings. In the drawings, like numerals describe substantially similar components throughout the several views. These embodiments are described in sufficient detail to enable those skilled in the art to practice the present subject matter. Other embodiments may be utilized and changes may be made. The scope of the present subject matter is defined only by the appended claims, along with the full scope of equivalents to which such claims are entitled.

FIGS. 3–6 illustrate a baby bottle holder 30. The baby bottle holder 30 includes a stuffed toy body, such as stuffed animal body 31, and a sleeve 32 extending through stuffed toy body 31 to form at least one opening 33 in stuffed animal body 31. Sleeve 32 includes a first end 34 and a second end 35.

Figure 5:
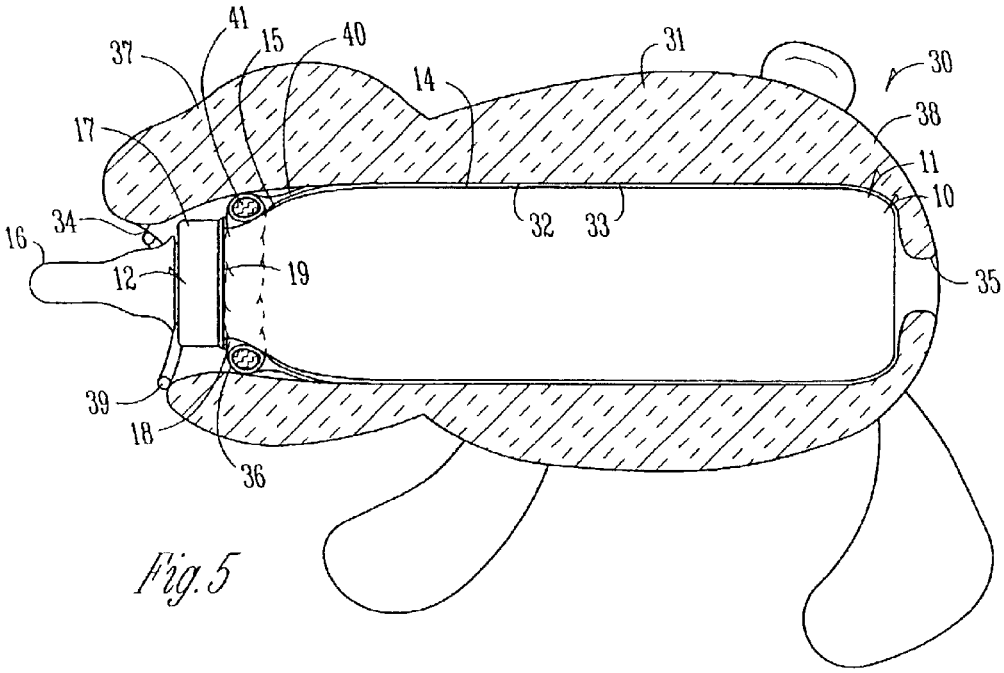
FIG. 5 is a section taken along line 5—5 in FIG. 3.
Figure 6:
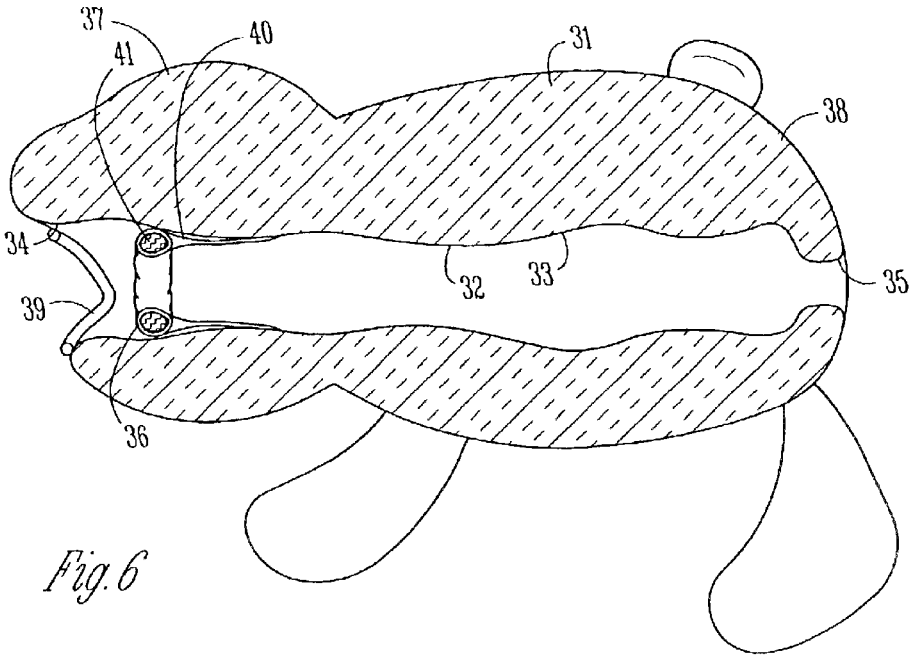
FIG. 6 is a section view similar to FIG. 5 with the baby bottle removed from the baby bottle holder.

As shown most clearly in FIGS. 5 and 6, baby bottle holder 30 further includes a bottle retainer 36 that is positioned within sleeve 32. Bottle retainer 36 is spaced from the first and second ends 34, 35 of sleeve 32.

In the illustrated example embodiment, opening 33 extends out of a head 37 on stuffed animal body 31. In some embodiments, opening 33 extends out of a mouth 39 in head 37 and also extends out of a bottom 38 of stuffed animal body 31.

As shown in FIG. 6, opening 33 defined by sleeve 32 may be smaller than the diameter of baby bottle 10. Since opening 33 is smaller than baby bottle 10, baby bottle 10 compresses sleeve 32 outward as it is inserted into opening 33 (compare FIGS. 5 and 6).

In the illustrated example embodiments, bottle retainer 36 is positioned within sleeve 32 to secure a baby bottle 10 that is similar to the one shown in FIG. 1 within stuffed animal body 31. Baby bottle 10 is secured within sleeve 32 by bottle retainer 36 such that only a nipple 16 of baby bottle 10 is exposed outside stuffed animal body 31. Although bottle retainer 36 is shown positioned within sleeve 32 closer to first end 34 than second end 35, it should be noted that bottle retainer 36 may be positioned anywhere within sleeve 32 as long as bottle retainer 36 is spaced from first end 34 and second end 35.

In some embodiments, bottle retainer 36 includes a skirt 40 that is attached to sleeve 32 and an elastic band 41 that is attached to skirt 40 (see FIGS. 5 and 6). Elastic band 41 may form an opening that is smaller than a neck 15 of baby bottle 10. In the illustrated embodiment, elastic band 41 is positioned to secure the neck 15 of baby bottle 10 such that only nipple 16 of baby bottle 10 is exposed outside stuffed animal body 31.

Elastic band 41 expands as bottle 10 is inserted through bottle retainer 36 inside opening 33 in stuffed animal body 31. Elastic band 41 moves partially back toward its original size when elastic band 41 engages recess 18 on baby bottle 10. Once elastic band 41 is positioned within recess 18 of bottle 10, the compressive force generated by elastic band 41 on bottle 10 as well as the lateral constraint provided by lower edge 19 of base 17 and neck 15 against elastic band 41 serve to secure bottle 10 inside stuffed animal body 31.

Elastic band 41 and skirt 40 of bottle retainer 36 may be made from an insulating, moisture-proof material. In addition, sleeve 32 may be made from an insulating, moisture-proof material. Sleeve 32 may also be formed in multiple layers or be made from a multilayer material.

Figure 7:
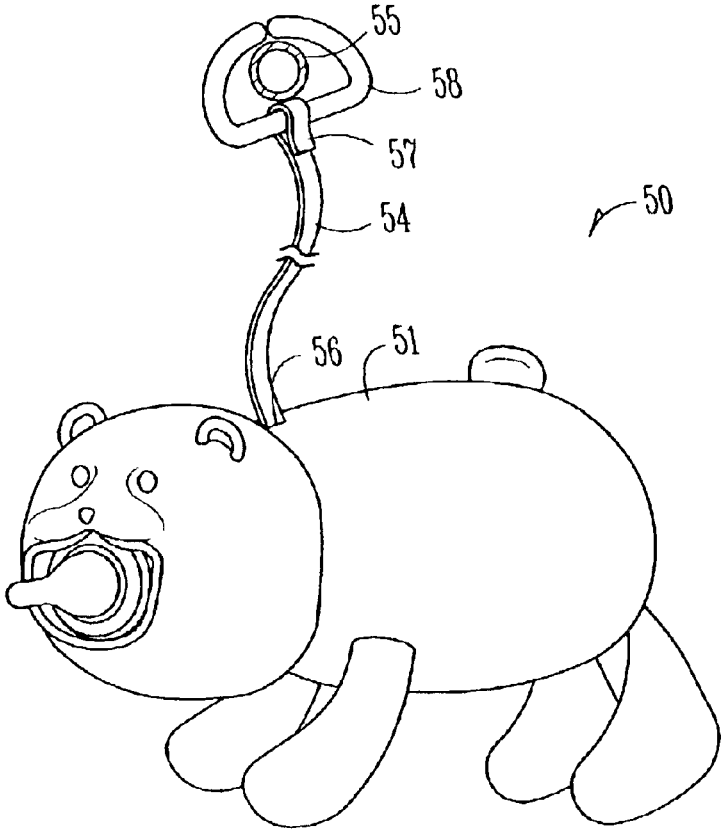
FIG. 7 is a perspective view illustrating another example embodiment of a baby bottle holder.

FIG. 7 illustrates another example embodiment of a baby bottle holder 50. Baby bottle holder 50 includes a stuffed toy body 51 and a sleeve (not visible in FIG. 7) extending through stuffed toy body 51 to form at least one opening in stuffed toy body 51 which can receive a baby bottle. Baby bottle holder 50 further includes a tether 54 that is attached to stuffed toy body 51 such that the tether can be used to secure baby bottle holder 50 to an object, such as a handle 55 of a stroller or the like.

In some embodiments, one end 56 of tether 54 is stitched to stuffed toy body 51. It should be noted that tether 54 may be connected to stuffed toy body 51 by any conventional means, including but not limited to snaps, buttons, hooks and VELCRO. Tether 54 may also be secured to a loop (not shown) that is attached to stuffed toy body 51.

In the illustrated embodiment, an opposing end 57 of tether 54 is attached to a clip 58 that allows baby bottle holder 50 to be attached to an object, such as handle 55. Clip 58 is particularly convenient because it can be readily snapped and unsnapped to/from many objects. It should be noted that any known type fastening member can be placed at opposing end 57 of tether 54, or no fastening member at all might be used such that tether 54 would have to be tied to an object.

In some embodiments, stuffed toy body 51 is a stuffed animal body and tether 54 is designed to simulate an animal leash. When tether 54 simulates an animal leash, the overall appearance of baby bottle holder 50 is enhanced.

Although specific embodiments have been illustrated and described herein, it will be appreciated by those of ordinary skill in the art that any arrangement which is calculated to achieve the same purpose may be substituted for the specific embodiments shown. This application is intended to cover a baby bottle holder where the first end of the sleeve is open and the second end of the sleeve is closed and other embodiments where the first and second ends of the sleeve are open.

It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. A baby bottle holder comprising:

a stuffed toy body;

a sleeve extending through the stuffed toy body to form at least one opening in the stuffed toy body that is adapted to receive a baby bottle, the sleeve including a first open end in a mouth of a head on the stuffed toy body; and a bottle retainer including a skirt having an inner and outer edge, the outer edge being attached to the sleeve and the inner edge being attached to an elastic band, the skirt extending between the sleeve and the elastic band, the elastic band being adapted to form an opening that is smaller than a neck of the baby bottle, the skirt and elastic band being spaced from the first end of the sleeve.

2. The baby bottle holder of claim 1 wherein the stuffed toy body is a stuffed animal body.

3. The baby bottle holder of claim 2 wherein the a second end of the sleeve provides an opening in a bottom of the stuffed animal body.

4. The baby bottle holder of claim 1 wherein the bottle retainer is positioned within the sleeve such that when a baby bottle is secured within the stuffed toy body only a nipple of the baby bottle is exposed outside the stuffed toy body.

5. The baby bottle holder of claim 3 wherein the bottle retainer is positioned within the sleeve closer to the first end than the second end.

6. The baby bottle holder of claim 1 wherein the sleeve defines an opening that is smaller than the diameter of a baby bottle.

7. The baby bottle holder of claim 1 wherein the elastic band is positioned within the sleeve such that when the neck of the baby bottle is secured within the elastic band only a nipple of the baby bottle is exposed outside the stuffed toy body.

8. The baby bottle holder of claim 1 wherein the elastic band and skirt of the bottle retainer are made from an insulating, moisture-proof material.

9. The baby bottle holder of claim 1 wherein the sleeve is made from an insulating, moisture-proof material.

10. The baby bottle holder of claim 2, further comprising a tether attached to the stuffed animal body to secure the baby bottle holder to an object, the tether simulating an animal leash.

11. The baby bottle holder of claim 10 wherein one end of the tether is stitched to the stuffed animal body.

12. The baby bottle holder of claim 11 wherein an opposing end of the tether includes a clip for attaching the baby bottle holder to an object.

13. A baby bottle holder comprising:

a stuffed toy body;

a sleeve extending through the stuffed toy body to form at least one opening in the stuffed toy body that is adapted to receive a baby bottle, the sleeve including a first open end in a mouth of a head on the stuffed toy body; and a bottle retainer including a skirt having an inner and outer edge, the outer edge being attached to the sleeve and the inner edge being attached to an elastic band, the skirt extending between the sleeve and the elastic band, the elastic band being adapted to form an opening that is smaller than a neck of the baby bottle, the skirt and elastic band being spaced from the first end of the sleeve such that only a nipple of the baby bottle is exposed outside the mouth of the stuffed toy body when the baby bottle is secured by the elastic band.

14. A baby bottle holder comprising:

a stuffed animal body;

a sleeve extending through the stuffed animal body to form at least one opening in the stuffed animal body that is smaller than a container of a baby bottle, the sleeve including a first open end in a mouth of a head on the stuffed animal body and a second open end in a bottom of the stuffed animal body; and a bottle retainer including a skirt having an inner and outer edge, the outer edge being attached to the sleeve and the inner edge being attached to an elastic band, the skirt extending between the sleeve and the elastic band, the elastic band being adapted to form an opening that is smaller than a neck of the baby bottle, the skirt and elastic band being spaced from the first and second ends of the sleeve such that only a nipple of the baby bottle is exposed outside the mouth of the stuffed animal body when the baby bottle is secured by the elastic band.

* * * * *

UNITED STATES PATENT AND TRADEMARK OFFICE

CERTIFICATE OF CORRECTION

PATENT NO. : 6,824,112 B2
DATED : November 30, 2004
INVENTOR(S) : Lange

It is certified that error appears in the above-identified patent and that said Letters Patent is hereby corrected as shown below:

Column 4,
Line 63, after "wherein" delete "the".

Signed and Sealed this

First Day of March, 2005

JON W. DUDAS
*Director of the United States Patent and Trademark Office*